US008764565B2

(12) United States Patent
Page

(10) Patent No.: US 8,764,565 B2
(45) Date of Patent: Jul. 1, 2014

(54) APPARATUS AND METHOD OF AUDIO REPRODUCTION

(75) Inventor: Jason Anthony Page, London (GB)

(73) Assignee: Sony Computer Entertainment Europe Limited (GB)

( * ) Notice: Subject to any disclaimer, the term of this patent is extended or adjusted under 35 U.S.C. 154(b) by 109 days.

(21) Appl. No.: 13/205,968

(22) Filed: Aug. 9, 2011

(65) Prior Publication Data

US 2012/0040757 A1 Feb. 16, 2012

(30) Foreign Application Priority Data

Aug. 11, 2010 (EP) ..... 10172483

(51) Int. Cl.
*G07F 17/32* (2006.01)

(52) U.S. Cl.
USPC ..... 463/35

(58) Field of Classification Search
USPC ..... 463/35
See application file for complete search history.

(56) References Cited

U.S. PATENT DOCUMENTS

| | | | | |
|---|---|---|---|---|
| 3,512,088 | A * | 5/1970 | Ross | 455/149 |
| 5,913,727 | A | 6/1999 | Ahdoot | |
| 2009/0081948 | A1 | 3/2009 | Banks et al. | |
| 2012/0269361 | A1 * | 10/2012 | Bhow et al. | 381/81 |

FOREIGN PATENT DOCUMENTS

| | | | |
|---|---|---|---|
| WO | 2006/100644 | A2 | 9/2006 |
| WO | 2008/061023 | A2 | 5/2008 |
| WO | 2009/143385 | A2 | 11/2009 |

OTHER PUBLICATIONS

European Search Report, EP 10172483, dated Mar. 7, 2011.

* cited by examiner

*Primary Examiner* — Pierre E Elisca
(74) *Attorney, Agent, or Firm* — Lerner, David, Littenberg, Krumholz & Mentlik, LLP

(57) ABSTRACT

A wearable loudspeaker unit comprises a loudspeaker, an audio reproduction processor, a wireless communications unit operable to communicate wirelessly with a base unit using a protocol that distinguishes the wearable loudspeaker unit from any other wearable loudspeaker units in communication with the base unit, and a user input interface operable to select one of a plurality of wearable loudspeaker unit wearing positions on a user's body; and the wireless communications unit is operable to transmit the selected wearing position of the wearable loudspeaker unit to the base unit, and is operable to receive audio data corresponding to the selected wearing position of the wearable loudspeaker unit from the base unit, and the audio reproduction processor is operable to output the received audio data through the loudspeaker.

19 Claims, 5 Drawing Sheets

APPARATUS AND METHOD OF AUDIO REPRODUCTION

CROSS REFERENCE TO RELATED APPLICATIONS

The present application claims the benefit of and priority to EP Application No. 10/172,483.9, filed Aug. 11, 2010, the entire disclosure of which is incorporated by reference herein.

BACKGROUND OF THE INVENTION

1. Field of the Invention

The present invention relates to an apparatus and method of audio reproduction.

2. Description of the Prior Art

Conventional videogame platforms attempt to provide users with an immersive gaming experience. To this end, they use high quality graphics generators that can provide near photorealistic images, and with the recent advent of domestic 3D (stereoscopic) television, are also providing stereoscopic graphics.

In addition, such videogame platforms as the Sony® Playstation 3® (PS3®) device also use high quality audio generators that can provide surround sound such as so called '5.1' or '7.1' surround sound (where the number preceding the decimal point relates to the number of conventional loudspeakers distributed around the playing space, and the '0.1' refers to a subwoofer).

To further enhance the immersive game experience, recently game controllers have also included motion detectors in order to replicate user motion within a game. Examples of such controllers include the Nintendo® Wiimote® controller and the Sony® Move® motion controller for the Playstation 3® system. The Wiimote in particular contains a small integral loudspeaker, so that it can make noises appropriate to its in-game use—for example a 'bang' when used as a gun.

Thus a user can now play within a stereoscopic graphics environment, with surround sound, and have their movements replicated within a game.

However, it will be appreciated that there is still scope to further improve the immersive experience provided by a video games platform. It is an object of the present invention to provide an improved video game experience to a user.

SUMMARY OF THE INVENTION

A first aspect of the present invention provides a wearable loudspeaker unit, comprising:

a loudspeaker;

an audio reproduction processor;

a wireless communications unit operable to communicate wirelessly with a base unit using a protocol that distinguishes the wearable loudspeaker unit from any other wearable loudspeaker units in communication with the base unit; and a user input interface operable to select one of a plurality of wearable loudspeaker unit wearing positions on a user's body; and in which the wireless communications unit is operable to transmit the selected wearing position of the wearable loudspeaker unit to the base unit, and is operable to receive from the base unit a respective one of a plurality of different audio data that corresponds to the respective selected wearing position of the wearable loudspeaker unit; and the audio reproduction processor is operable to output the received audio data through the loudspeaker.

Another aspect of the present invention provides a base unit, comprising:

a processor;

a wireless communications unit operable to communicate wirelessly with one or more wearable loudspeaker units using a protocol that distinguishes each wearable loudspeaker unit from each other wearable loudspeaker unit in communication with the base unit; and a user input interface operable to select a respective one of a plurality of wearable loudspeaker unit wearing positions on a user's body for the or each wearable loudspeaker unit in communication with the base unit; and in which the processor is operable to select a respective one of a plurality of different audio data that corresponds to the respective selected wearing position of a respective wearable loudspeaker unit for transmission by the wireless communications unit to that respective wearable loudspeaker unit.

Another aspect of the invention provides a base unit, comprising:

a processor;

a wireless communications unit operable to communicate wirelessly with one or more wearable loudspeaker units using a protocol that distinguishes each wearable loudspeaker unit from each other wearable loudspeaker unit in communication with the base unit;

an image input means for receiving a captured video image; and an image recognition means operable to detect a respective one of a plurality of wearable loudspeaker unit wearing positions on a user's body for the or each wearable loudspeaker unit in communication with the base unit according to the detected positions of the or each wearable loudspeaker within the captured video image; and in which the processor is operable to select a respective one of a plurality of different audio data that corresponds to the respective detected wearing position of a respective wearable loudspeaker unit for transmission by the wireless communications unit to that respective wearable loudspeaker unit.

Another aspect of the present invention provides a method of audio reproduction for a wearable loudspeaker unit, the method comprising the steps of:

selecting at the wearable loudspeaker unit one of a plurality of wearable loudspeaker unit wearing positions on a user's body;

transmitting the selected wearing position of the wearable loudspeaker unit to a base unit;

receiving from the base unit a respective one of a plurality of different audio data corresponding to the respective selected wearing position of the wearable loudspeaker unit; and outputting the received audio data through the loudspeaker.

Another aspect of the present invention provides a method of audio reproduction for a base unit, the method comprising the steps of:

selecting at the base unit one of a plurality of wearable loudspeaker unit wearing positions on a user's body for one or more respective wearable loudspeaker units in communication with the base unit; and selecting at the base unit a respective one of a plurality of different audio data that corresponds to the selected wearing position of a respective wearable loudspeaker unit for transmission by the wireless communications unit of the base unit to that respective wearable loudspeaker unit.

Another aspect of the present invention provides a method of audio reproduction for an audio system comprising a base unit and one or more wearable loudspeaker units in communication with the base unit, the method comprising the steps of:

selecting one of a plurality of wearable loudspeaker unit wearing positions on a user's body for the or each respective wearable loudspeaker unit; and selecting a respective one of a plurality of different audio data corresponding to the selected wearing position of a respective wearable loudspeaker unit for transmission by the base unit to that respective wearable loudspeaker unit.

Further respective aspects and features of the invention are defined in the appended claims.

BRIEF DESCRIPTION OF THE DRAWINGS

The above and other objects, features and advantages of the invention will be apparent from the following detailed description of illustrative embodiments which is to be read in connection with the accompanying drawings, in which.

DESCRIPTION OF THE PREFERRED EMBODIMENTS

An apparatus and method of audio reproduction are disclosed. In the following description, a number of specific details are presented in order to provide a thorough understanding of the embodiments of the present invention. It will be apparent, however, to a person skilled in the art that these specific details need not be employed to practise the present invention. Conversely, specific details known to the person skilled in the art are omitted for the purposes of clarity where appropriate.

Figure 1:
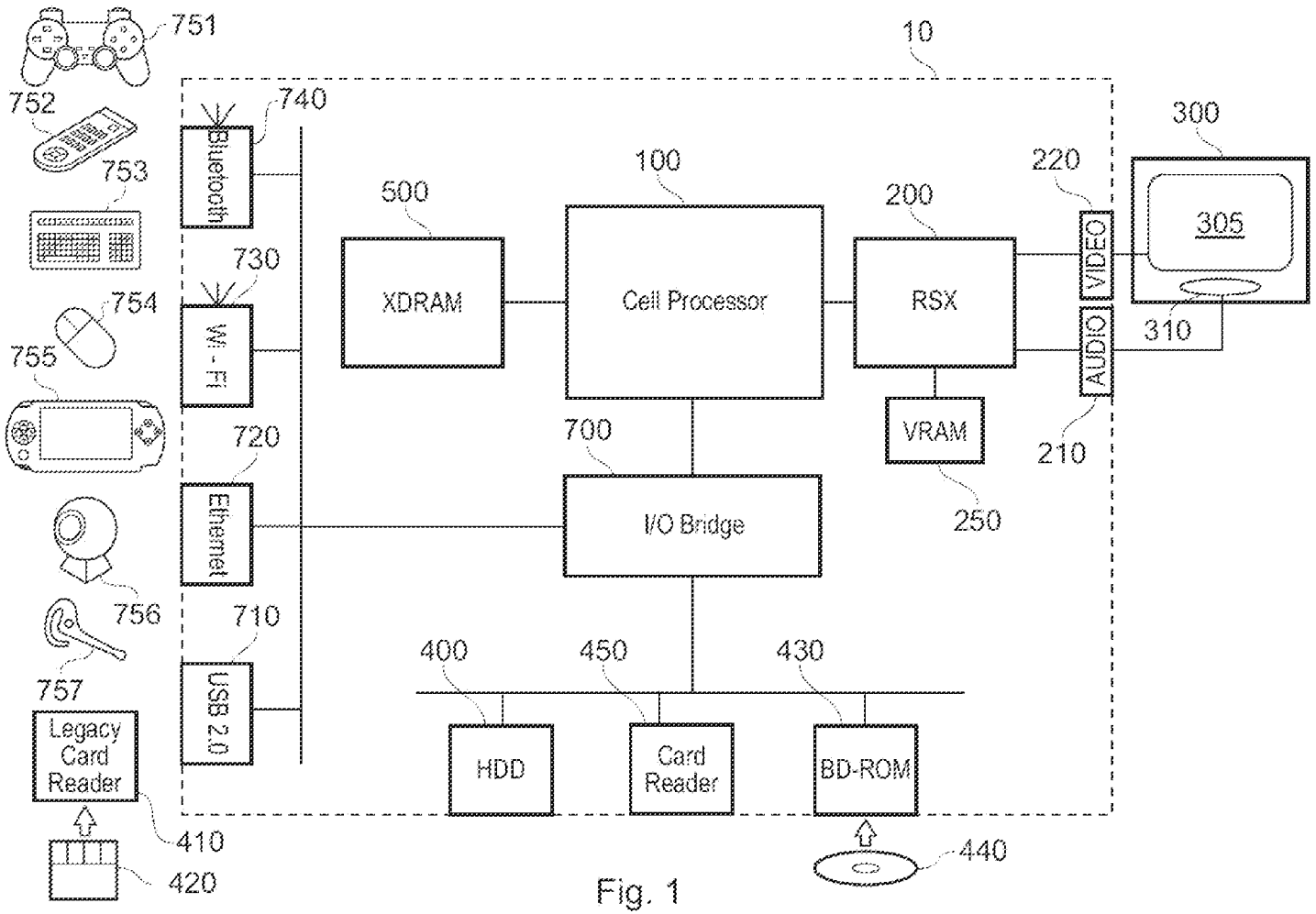
FIG. 1 is a schematic diagram of a base unit in accordance with an embodiment of the present invention.

FIG. 1 schematically illustrates the overall system architecture of the Sony® Playstation 3® entertainment device operable as a base unit. A system unit 10 of the entertainment device is provided, with various peripheral devices connectable to the system unit.

The system unit 10 comprises: a Cell processor 100; a Rambus® dynamic random access memory (XDRAM) unit 500; a Reality Synthesiser graphics unit 200 with a dedicated video random access memory (VRAM) unit 250; and an I/O bridge 700.

The system unit 10 also comprises a Blu Ray® Disk BD-ROM® optical disk reader 430 for reading from a disk 440 and a removable slot-in hard disk drive (HDD) 400, accessible through the I/O bridge 700. Optionally the system unit also comprises a memory card reader 450 for reading compact flash memory cards, Memory Stick® memory cards and the like, which is similarly accessible through the I/O bridge 700.

The I/O bridge 700 also connects to four Universal Serial Bus (USB) 2.0 ports 710; a gigabit Ethernet port 720; an IEEE 802.11b/g wireless network (Wi-Fi) port 730; and a Bluetooth® wireless link port 740 capable of supporting up to seven Bluetooth connections.

In operation the I/O bridge 700 handles all wireless, USB and Ethernet data, including data from one or more game controllers 751. For example when a user is playing a game, the I/O bridge 700 receives data from the game controller 751 via a Bluetooth link and directs it to the Cell processor 100, which updates the current state of the game accordingly.

The wireless, USB and Ethernet ports also provide connectivity for other peripheral devices in addition to game controllers 751, such as: a remote control 752; a keyboard 753; a mouse 754; a portable entertainment device 755 such as a Sony Playstation Portable® entertainment device; a video camera such as an EyeToy® video camera 756; and a microphone headset 757. Such peripheral devices may therefore in principle be connected to the system unit 10 wirelessly; for example the portable entertainment device 755 may communicate via a Wi-Fi ad-hoc connection, whilst the microphone headset 757 may communicate via a Bluetooth link Consequently the USB and Ethernet and wireless connections may act, for example, as image input means for receiving a captured video image from a video camera.

The provision of these interfaces means that the Playstation 3 device is also potentially compatible with other peripheral devices such as digital video recorders (DVRs), set-top boxes, digital cameras, portable media players, Voice over IP telephones, mobile telephones, printers and scanners.

In addition, a legacy memory card reader 410 may be connected to the system unit via a USB port 710, enabling the reading of memory cards 420 of the kind used by the Playstation® or Playstation 2® devices.

In the present embodiment, the game controller 751 is operable to communicate wirelessly with the system unit 10 via the Bluetooth link. However, the game controller 751 can instead be connected to a USB port, thereby also providing power by which to charge the battery of the game controller 751. In addition to one or more analog joysticks and conventional control buttons, the game controller is sensitive to motion in 6 degrees of freedom, corresponding to translation and rotation in each axis. Consequently gestures and movements by the user of the game controller may be translated as inputs to a game in addition to or instead of conventional button or joystick commands. Optionally, other wirelessly enabled peripheral devices such as the Playstation Portable device or the Playstation Move® may be used as a controller. In the case of the Playstation Portable device, additional game or control information (for example, control instructions or number of lives) may be provided on the screen of the device. In the case of the Playstation Move, control information may be provided both by internal motion sensors and by video monitoring of a light on the Playstation Move device. Other alternative or supplementary control devices may also be used, such as a dance mat (not shown), a light gun (not shown), a steering wheel and pedals (not shown) or bespoke controllers, such as a single or several large buttons for a rapid-response quiz game (also not shown).

The remote control 752 is also operable to communicate wirelessly with the system unit 10 via a Bluetooth link. The remote control 752 comprises controls suitable for the operation of the Blu Ray Disk BD-ROM reader 430 and for the navigation of disk content.

The Blu Ray Disk BD-ROM reader 430 is operable to read CD-ROMs compatible with the Playstation and PlayStation 2 devices, in addition to conventional pre-recorded and recordable CDs, and so-called Super Audio CDs. The reader 430 is also operable to read DVD-ROMs compatible with the Playstation 2 and PlayStation 3 devices, in addition to conventional pre-recorded and recordable DVDs. The reader 430 is further operable to read BD-ROMs compatible with the Playstation 3 device, as well as conventional pre-recorded and recordable Blu-Ray Disks.

The system unit 10 is operable to supply audio and video, either generated or decoded by the Playstation 3 device via the Reality Synthesiser graphics unit 200, through audio and video connectors to a display and sound output device 300 such as a monitor or television set having a display 305 and one or more loudspeakers 310. The audio connectors 210 may include conventional analogue and digital outputs whilst the video connectors 220 may variously include component video, S-video, composite video and one or more High Definition Multimedia Interface (HDMI) outputs. Consequently, video output may be in formats such as PAL or NTSC, or in 720p, 1080i or 1080p high definition.

Audio processing (generation, decoding and so on) is performed by the Cell processor 100. The Playstation 3 device's operating system supports Dolby® 5.1 surround sound, Dolby® Theatre Surround (DTS), and the decoding of 7.1 surround sound from Blu-Ray® disks.

In the present embodiment, the video camera 756 comprises a single charge coupled device (CCD), an LED indicator, and hardware-based real-time data compression and encoding apparatus so that compressed video data may be transmitted in an appropriate format such as an intra-image based MPEG (motion picture expert group) standard for decoding by the system unit 10. The camera LED indicator is arranged to illuminate in response to appropriate control data from the system unit 10, for example to signify adverse lighting conditions. Embodiments of the video camera 756 may variously connect to the system unit 10 via a USB, Bluetooth or Wi-Fi communication port. Embodiments of the video camera may include one or more associated microphones and also be capable of transmitting audio data. In embodiments of the video camera, the CCD may have a resolution suitable for high-definition video capture. In use, images captured by the video camera may for example be incorporated within a game or interpreted as game control inputs.

In general, in order for successful data communication to occur with a peripheral device such as a video camera or remote control via one of the communication ports of the system unit 10, an appropriate piece of software such as a device driver should be provided. Device driver technology is well-known and will not be described in detail here, except to say that the skilled man will be aware that a device driver or similar software interface may be required in the present embodiment described.

Figure 2:
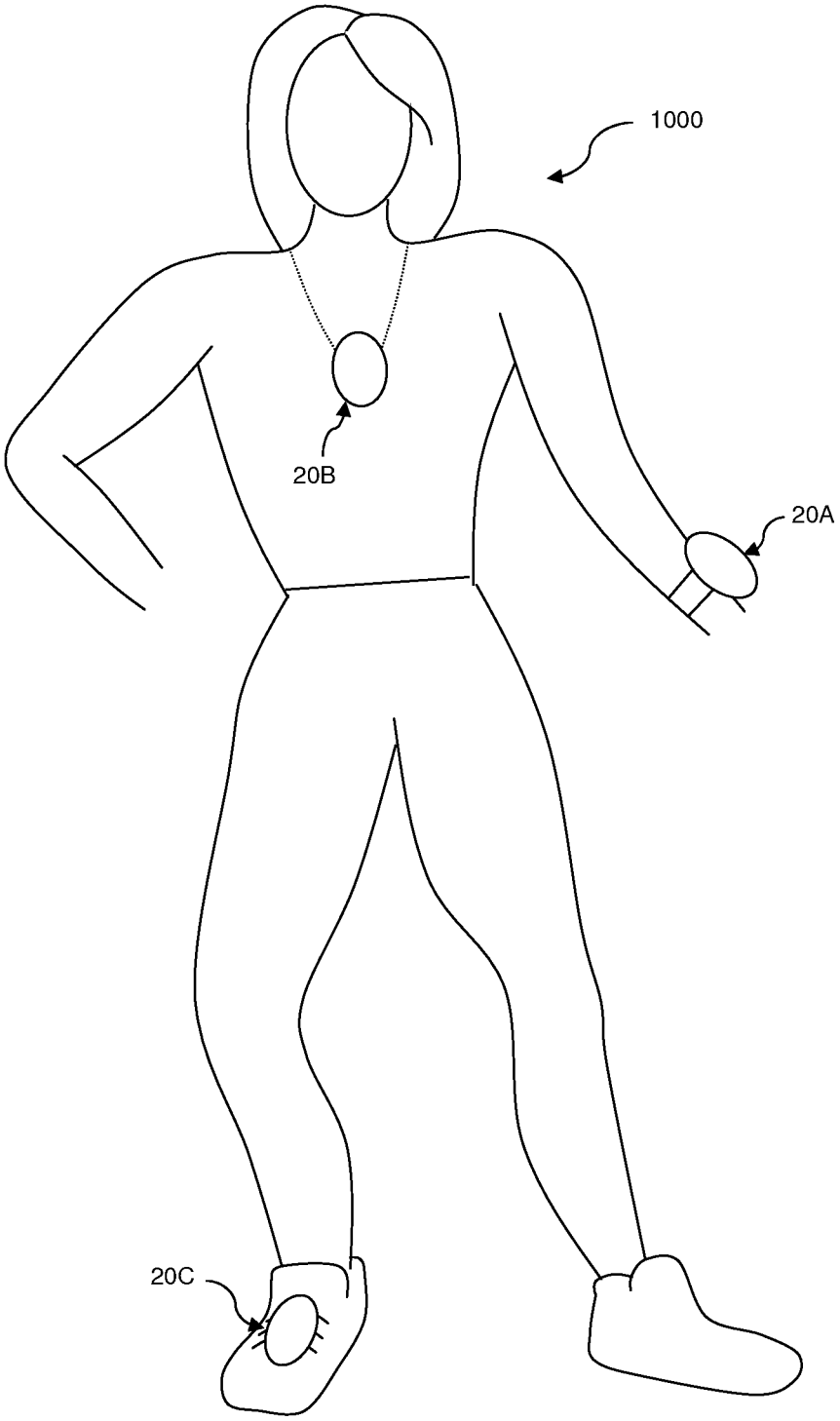
FIG. 2 is a schematic diagram of a user wearing a plurality of so-called bodyspeakers in accordance with an embodiment of the present invention.

Turning now to FIG. 2, in an embodiment of the present invention, a user 1000 interacts with the PS3 base unit (not shown) in the manner described above via a controller 751 such as the SIXAXIS or Move controller (not shown), for example via a wireless Bluetooth® connection.

In addition, in an embodiment of the present invention the user wears one or more wearable loudspeaker units 20A, 20B, 20C (hereafter 'bodyspeakers') on different parts of their body. Thus as a non-limiting example, a first bodyspeaker 20A can be worn on the wrist (secured for example with a Velcro® strap or buckled strap); a second bodyspeaker 20B can be worn on the torso (secured for example by a strap around the neck); and a third body speaker can be worn on the foot (secured for example by being tied into shoelaces).

It will be appreciated that the means of attachment can vary; for example, a bodyspeaker worn on the torso may be secured by a strap around the chest and back, whilst a bodyspeaker on the foot may use a Velcro strap around the ankle. Similarly, a body speaker attached to any limb may be housed within a pocket of an elasticated tube to be worn on that limb, or may use a strap with a buckle for adjustment. Other means of wearing such a device will be apparent to a person skilled in the art.

Figure 3:
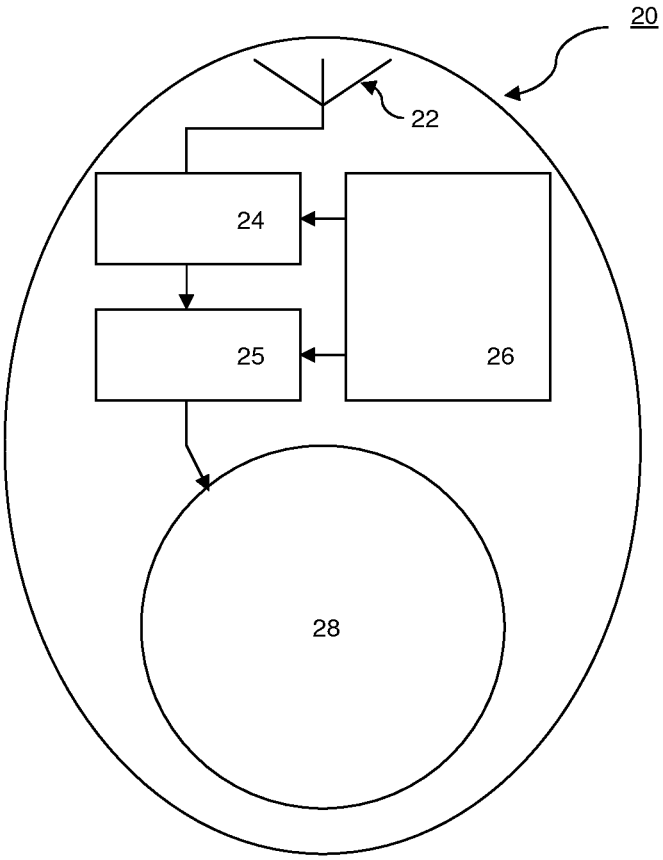
FIG. 3 is a schematic diagram of a bodyspeaker in accordance with an embodiment of the present invention.

Referring now to FIG. 3, each bodyspeaker 20 has an antenna 22 for establishing a wireless link to the PS3, which operates as a base unit for the or each bodyspeaker. The antenna is coupled to a wireless communications unit 24 operable to communicate wirelessly with the PS3 base unit using a protocol such as Bluetooth that distinguishes each bodyspeaker from any other bodyspeakers in communication with the same PS3 base unit.

It will be understood that therefore conversely the PS3 base unit comprises a similar wireless communications unit operable to communicate wirelessly with one or more bodyspeakers using a protocol such as Bluetooth that distinguishes each bodyspeaker from each other bodyspeaker in communication with the PS3 base unit. For example, the Bluetooth or wireless interfaces (740, 730) may provide this function.

The wireless communications unit in the bodyspeaker is operably coupled to an audio reproduction processor 25 that provides audio data memory and processing facilities. Such processors, or combinations of components providing such facilities, are known in the art. Alternatively, an application specific integrated circuit (ASIC) providing these facilities may be produced. The audio data memory may be part of the processor architecture, separate to it, or a combination of the two.

The wireless communications unit 24 and the audio reproduction processor 25 are powered by a battery 26. The battery may be of a rechargeable type and optionally may be inaccessible to the user (e.g. no battery access hatch or similar may be provided).

In operation, the audio reproduction processor receives audio data from the PS3 base unit using the wireless link provided by the wireless communications unit. The audio reproduction processor then outputs the received audio data through a loudspeaker 28, thereby reproducing audio in the bodyspeaker.

In a first instance, the audio data may be streamed from the PS3 base unit to the bodyspeaker for reproduction as required. Alternatively or in addition, in a second instance the audio data may be uploaded as one or more audio data files before reproduction is required and stored in the audio data memory of the audio reproduction processor (and/or in a further audio data memory, not shown). If multiple audio files are uploaded and stored, each audio file may be associated with a code or similar identifier. In this case, the wireless communications unit is operable to receive a command from the PS3 base unit that identifies a file of audio data for reproduction by the audio reproduction processor. Hence the PS3 base unit can cause the bodyspeaker to reproduce the desired audio data/file by transmitting to the bodyspeaker a command that includes the respective identifier, for example in response to an in-game event relating to the respective bodyspeaker's wearing position on the user's body.

The first instance is of particular benefit where the audio data would be too large to store in the audio data memory of the bodyspeaker, or where in-game environmental effects (such as echoes, or filtering to generate an underwater effect) are applied by the PS3 base unit to the audio data in response to the current conditions of the game.

The second instance is of particular use for frequently and repeatedly used sounds, such as for example gunshots or footsteps. In this case, for example, ten audio files for footsteps could be pre-loaded representing different surfaces in the game such as gravel paths, metal gangways, wooden floors and pavements. Several examples of each could be stored to provide further variation; the PS3 can then send commands to the bodyspeaker identifying which audio file to reproduce at a given moment.

It will be appreciated that in either case, different audio data is available for each of a plurality of bodyspeaker wearing positions supported by a particular game. Thus for example a game will comprise two or more different sets of available audio data to upload to a bodyspeaker, or two or more different available streams of audio data, for two or more supported bodyspeaker wearing positions. The PS3 base unit then selects a respective one of the plurality of different audio data for a respective bodyspeaker according to its worn position, whilst not selecting the other audio data that corresponds to respective other bodyspeaker wearing positions.

In an embodiment of the present invention, the bodyspeaker audio reproduction processor 25 also comprises an audio effects processor capable of applying one or more environmental effects to audio data. In this case, the wireless communications unit is operable to receive a command from the base unit that specifies an audio effect to apply to audio output to the loudspeaker. Hence when the bodyspeaker reproduces either streamed audio or a stored audio file, the PS3 base unit may transmit a command specifying an environmental effect to apply to the audio, and, if required, any parameter data used to vary the effect (for example, delay and decay values for an echo effect, or attenuation levels for frequency bands of a filter bank).

The Bluetooth protocol enables each bodyspeaker to be uniquely identified and addressed, though it will be appreciated that other suitable wireless protocols that enable multiple bodyspeakers to be similarly distinguished may be used (for example based on frequency assignment between bodyspeakers).

Consequently, the sounds and commands send to a bodyspeaker are specific to that bodyspeaker, and hence also specific to where the bodyspeaker is worn on the body.

Using the example above, thus only a bodyspeaker attached to a user's foot will receive audio data relating to footsteps, whilst only a bodyspeaker attached to a user's torso will receive audio data relating to a particular sound of a sword blow on armor, or receiving a gunshot. Meanwhile, only a bodyspeaker attached to a user's wrist will receive audio relating to a punch hit.

Consequently, the sounds reproduced by a bodyspeaker are dependent upon where it is worn on the body.

Figure 4:
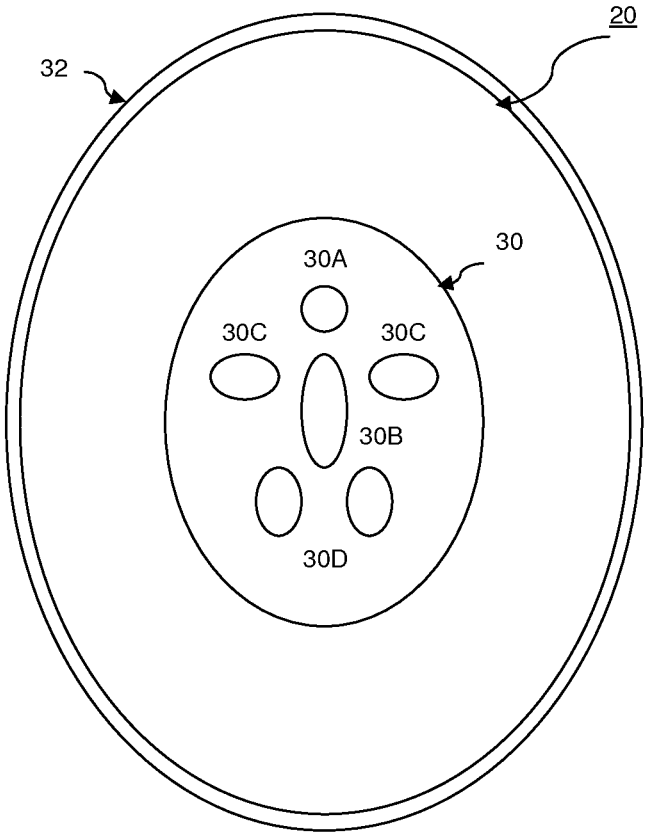
FIG. 4 is a schematic diagram of a bodyspeaker in accordance with an embodiment of the present invention.

Referring now to FIG. 4, in an embodiment of the present invention, the audio system comprising a PS3 base unit and one or more bodyspeakers co-operates to detect where the or each bodyspeaker is being worn.

In FIG. 4, in an embodiment of the present invention, on the outside of a bodyspeaker is a user input interface 30 comprising a plurality of buttons arranged anthropomorphically and each corresponding to a wearing position of the bodyspeaker, so that they correspond to the head 30A, body 30B, arms 30C and legs 30D of a person. The user can then specify where they are wearing the bodyspeaker by pressing the relevant button. Alternative interfaces will be appreciated by a person skilled in the art, such as a selection dial.

Upon selection, the bodyspeaker then transmits the selected wearing position (for example as a position identification code) to the PS3 base unit, and the PS3 then associates that bodyspeaker (as identified via Bluetooth or a similar protocol) with that position on the user's body and subsequently transmits audio data and/or commands to that bodyspeaker corresponding to that wearing position.

The bodyspeaker can be reassigned to a different position, and hence receive different audio data, by pressing another button on the interface. Alternatively or in addition, the body speaker may be unassigned either by pressing the same button again, or turning the bodyspeaker off (if this facility is provided), or optionally by provision of a further dedicated button or combination of existing buttons for this purpose. Alternatively or in addition, it may be unassigned by subsequently selecting the same body position on another bodyspeaker that is in communication with the PS3 base unit (in which case a command to unassign the bodyspeaker will be sent by the PS3). Similarly, it may be unassigned through a menu or other user interface provided by the PS3 (for instance showing a body map showing currently assigned bodyspeakers), which then sends an unassign command to the deselected bodyspeaker.

Optionally, the selected button may be illuminated by an LED or similar to remind the user of which part of the body the bodyspeaker is currently assigned to (this may be of particular use in multiplayer games where bodyspeakers may be passed between players).

Alternatively or in addition, in an embodiment of the present invention the PS3 base unit generates an on-screen user input interface operable to select a respective one of a plurality of bodyspeaker wearing positions on a user's body for the or each bodyspeaker in communication with the PS3 base unit.

The PS3 base unit can then select audio data corresponding to the selected wearing position of a respective bodyspeaker to be transmitted to the respective bodyspeaker.

In this case, an optional user interface on the bodyspeaker may simply by a set of LEDs (light emitting diodes) in an anthropomorphic arrangement, which, upon receipt of data from the PS3 base unit indicating the assigned body part, the bodyspeaker illuminates accordingly.

Optionally each bodyspeaker may have a coloured portion 32. In this case, each bodyspeaker transmits data identifying its colour to the PS3 base unit so that this can be replicated within the on-screen user input interface, allowing the user to easily determine which bodyspeaker he is controlling on the interface.

This is of particular use where the user has already attached the speakers before assigning them, making identification of the corresponding bodyspeaker in a menu simpler.

It will be appreciated that if the bodyspeaker can be assigned to a wearing position though an on-screen user input interface, then buttons are not necessary on the bodyspeaker itself, although it will be appreciated that both the PS3 base unit and individual bodyspeakers can provide user input interfaces.

Alternatively or in addition, where each bodyspeaker has a coloured portion 32, then the position of the bodyspeaker on the user may be detected by the PS3 using a video camera 756 such as the EyeToy. For example, the wearing position of a bodyspeaker having a particular coloured portion may be assigned according to where it is detected on a body plan of the user as recognised using known recognition techniques.

Consequently the Cell processor of the PS3 would operate as an image recognition means operable to detect a respective one of a plurality of bodyspeaker wearing positions on a user's body for the or each bodyspeaker, according to the detected positions of the or each wearable loudspeaker within the captured video image.

In this case, there is then no requirement for the user to explicitly assign a wearing position via a user interface on the body speaker or an on-screen menu. Where the PS3 (or similar device) already uses colour cues in a captured image for control (such as with the PS3 Move system) then this process can be easily integrated into the existing control recognition system.

In any event, once a respective bodyspeaker has been assigned to a wearing position, then as noted previously the PS3 base unit (and more specifically, the cell processor of the PS3) is operable to select audio data corresponding to the selected wearing position of that bodyspeaker unit for transmission to that bodyspeaker, either as a stream or as an upload before reproduction is required.

For multiplayer games, the above arrangements may be modified slightly as follows. If bodyspeakers are respectively assigned to each of a plurality of players, then of course it is possible for multiple bodyspeakers to be associated with the same body position (e.g. the feet). In this instance, a bodyspeaker would not be unassigned when another bodyspeaker associated with a different player is assigned to the same body position.

In the case where image recognition is employed, if a body speaker is worn on the user's back it may not be visible in normal use. This may itself be indicative that it is being worn on the users back, enabling it to be assigned accordingly. Alternatively it may be explicitly assigned using one of the techniques described previously. Advantageously, having a body speaker positioned on the front and/or rear of the user makes it simple to determine if the user is facing towards or away from the video camera. This may then be integrated into a mode of game play, such as a hide-and-seek game or a wild-west dueling game, where the user must turn away from the screen until an audio cue (or the absence of or change in an audio cue) indicates that they must turn around.

Figure 5:
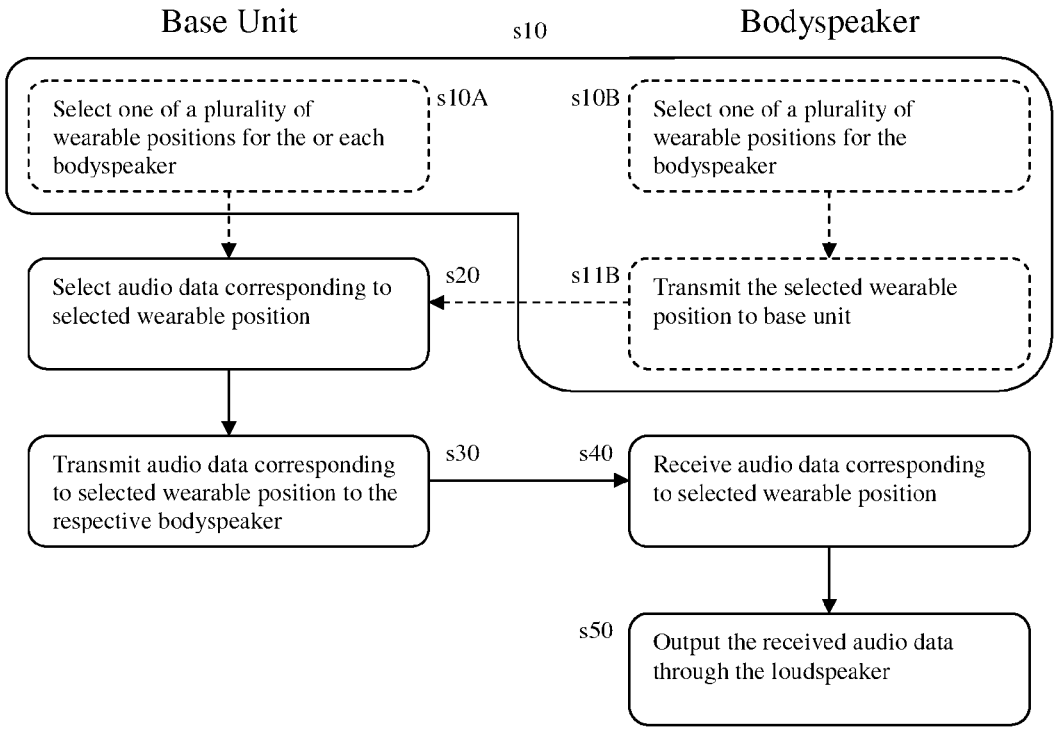
FIG. 5 is a flow diagram of a method of audio reproduction in accordance with an embodiment of the present invention.

Referring now to FIG. 5, a method of audio reproduction is disclosed. It will be appreciated from the above description that the assignment of a bodyspeaker may be performed either at the bodyspeaker itself via a user interface such as buttons on the bodyspeaker, or at the base unit via an on-screen interface, or a combination of the two. These alternative steps are represented by dotted lines in FIG. 5.

Thus a method of audio reproduction in accordance with an embodiment of the present invention comprises:

in a first step s10, selecting one of a plurality of wearable loudspeaker unit wearing positions on a user's body for the or each respective wearable loudspeaker unit in communication with the base unit; where step s10 may take the form of;

in a first instance s10A, selecting at the base unit one of a plurality of wearable positions for the or each bodyspeaker (e.g. via a menu or via image recognition), or in a second instance s10B, selecting at a bodyspeaker one of a plurality of wearable positions for the bodyspeaker, and in a subsequent step s11B, transmitting from the bodyspeaker the selected wearable position to the base unit;

in a second step s20, selecting at the base unit audio data corresponding to the selected wearable position, and in a third step s30, transmitting the selected audio data corresponding to the selected wearable position to the respective bodyspeaker.

In a fourth step s40, the respective bodyspeaker receives the audio data corresponding to its selected wearable position; and In a fifth step s50, the respective bodyspeaker outputs the received audio data through its loudspeaker.

Hence in an embodiment of the present invention, for a bodyspeaker with a user interface as described previously herein, a method of audio reproduction comprises selecting at the bodyspeaker one of a plurality of bodyspeaker wearing positions on a user's body, transmitting the selected wearing position of the bodyspeaker to the base unit, receiving audio data corresponding to the selected wearing position of the bodyspeaker from the base unit, and outputting the received audio data through the loudspeaker.

In an embodiment of the present invention, for a PS3 base unit with a user interface as described previously herein, a method of audio reproduction comprises selecting at the base unit one of a plurality of bodyspeaker wearing positions on a user's body for the or each respective bodyspeaker in communication with the base unit; and selecting at the base unit audio data corresponding to the selected wearing position of a respective bodyspeaker for transmission by the wireless communications unit of the base unit to that respective bodyspeaker.

Hence also, in an embodiment of the present invention, for an audio system comprising a base unit and at least one bodyspeaker, in which the base unit and/or the bodyspeakers comprise the user interface, then a method of audio reproduction comprises selecting one of a plurality of bodyspeaker wearing positions on a user's body for the or each respective bodyspeaker in communication with the base unit, and selecting audio data corresponding to the selected wearing position of a respective bodyspeaker for transmission by the wireless communications unit of the base unit to that respective bodyspeaker.

It will be apparent to a person skilled in the art that variations in the above methods corresponding to operation of the various embodiments of the apparatus as described and claimed herein are considered within the scope of the present invention.

It will be appreciated that the bodyspeakers disclosed herein provide several advantages.

Firstly, whilst surround sound provides an immersive audio soundstage it cannot provide the user with the immediacy of a sound (and, optionally a rumble) located on their body. For example, a bodyspeaker worn on the back would enable a game to clearly indicate that a user has been shot in the back; for many games this is a difficult situation to represent as the event cannot be easily shown on the screen in front of the user, whilst surround sound may not be sufficiently distinct (or the user may not have it). Hence the provision of a bodyspeaker means that a player will become more aware of the in-game environment beyond what can be seen on the screen in front of them, thereby heightening the game experience. In this case, if the bodyspeaker has a user interface 30 then for example pressing the torso button repeatedly may toggle between front and back positions, or two torso buttons may be provided.

Secondly, by having speakers separate to the handheld controller there is less constraint on size, meaning that the audio reproduction can be improved even for sounds one may expect near the controller position, such as gun shots. It can also be expected to improve battery life as the controller and speakers are independently powered.

Thirdly, because the bodyspeakers are not part of a controller, they can have a more ergonomic shape. For example, they may be encased in a soft foam, making them comfortable to wear, and/or they may be moulded to have a flat front by a curved back so as to be comfortably worn on the wrists or feet. Other designs will be apparent to the skilled person.

Finally, it will be appreciated that the methods disclosed herein may be carried out on conventional hardware suitably adapted as applicable by software instruction or by the inclusion or substitution of dedicated hardware.

For example, the assignment of bodyspeakers and the processing of audio effects may be performed primarily by the bodyspeakers, or primarily by a PS3, or by a combination of the two, as described herein.

Thus the required adaptation to existing parts of a conventional equivalent device may be implemented in the form of a computer program product or similar object of manufacture comprising processor implementable instructions which may be stored as a computer program product on (for example) a non-transitory data carrier such as a floppy disk, optical disk, hard disk, PROM, RAM, flash memory or any combination of these or other storage media, or transmitted via data signals on a network such as an Ethernet, a wireless network, the Internet, or any combination of these of other networks, or realised in hardware as an ASIC (application specific integrated circuit) or an FPGA (field programmable gate array) or other configurable circuit suitable to use in adapting the conventional equivalent device.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

What is claimed is:

1. A wearable loudspeaker unit, comprising:

a loudspeaker;

an audio reproduction processor;

a wireless communications unit operable to communicate wirelessly with a base unit using a protocol that distinguishes the wearable loudspeaker unit from any other wearable loudspeaker units in communication with the base unit; and a user input interface operable to select one of a plurality of wearable loudspeaker unit wearing positions on a user's body; and in which the wireless communications unit is operable to transmit the selected wearing position of the wearable loudspeaker unit to the base unit, and is operable to receive from the base unit a respective one of a plurality of different audio data that corresponds to the respective selected wearing position of the wearable loudspeaker unit; and the audio reproduction processor is operable to output the received audio data through the loudspeaker.

2. The wearable loudspeaker unit of claim 1, comprising:

audio data memory operable to store one or more received files of audio data; and in which the wireless communications unit is operable to receive a command from the base unit that identifies a file of audio data for reproduction by the audio reproduction processor.

3. The wearable loudspeaker unit of claim 1, in which:

the audio reproduction processor comprises an audio effects processor; and the wireless communications unit is operable to receive a command from the base unit that specifies an audio effect to apply to audio output to the loudspeaker.

4. The wearable loudspeaker unit of claim 1, in which the user input interface comprises a plurality of buttons each corresponding to a wearing position of the wearable loudspeaker unit on a user's body.

5. The wearable loudspeaker unit of claim 1, comprising:

one or more selected from the list consisting of:

i. a strap fastenable by hook and loop fasteners;

ii. a strap fastenable by a buckle;

iii. an elasticated tube with a pocket housing the wearable loudspeaker unit;

iv. a neck strap; and v. laces.

6. A base unit, comprising:

a processor;

a wireless communications unit operable to communicate wirelessly with one or more wearable loudspeaker units using a protocol that distinguishes each wearable loudspeaker unit from each other wearable loudspeaker unit in communication with the base unit; and a user input interface operable to select a respective one of a plurality of wearable loudspeaker unit wearing positions on a user's body for each wearable loudspeaker unit in communication with the base unit; and in which the processor is operable to select a respective one of a plurality of different audio data that corresponds to the respective selected wearing position of a respective wearable loudspeaker unit for transmission by the wireless communications unit to that respective wearable loudspeaker unit.

7. A base unit according to claim 6, in which:

the processor is operable to select audio data corresponding to the selected wearing position of a respective wearable loudspeaker unit to be uploaded by the wireless communications unit to that respective wearable loudspeaker unit before the audio data is required to be reproduced by that respective wearable loudspeaker unit; and the base unit is operable to subsequently transmit a command to the respective wearable loudspeaker unit to reproduce the selected audio data.

8. A base unit according to claim 6, in which the base unit is operable to transmit a command to a respective wearable loudspeaker unit to apply a processing effect to audio data that is being reproduced.

9. A base unit, comprising:

a processor;

a wireless communications unit operable to communicate wirelessly with one or more wearable loudspeaker units using a protocol that distinguishes each wearable loudspeaker unit from each other wearable loudspeaker unit in communication with the base unit;

an image input means for receiving a captured video image; and an image recognition means operable to detect a respective one of a plurality of wearable loudspeaker unit wearing positions on a user's body for each wearable loudspeaker unit in communication with the base unit according to the detected positions of each wearable loudspeaker within the captured video image; and in which the processor is operable to select a respective one of a plurality of different audio data that corresponds to the respective detected wearing position of a respective wearable loudspeaker unit for transmission by the wireless communications unit to that respective wearable loudspeaker unit.

10. A base unit according to claim 9, in which:

the processor is operable to select audio data corresponding to the selected wearing position of a respective wearable loudspeaker unit to be uploaded by the wireless communications unit to that respective wearable loudspeaker unit before the audio data is required to be reproduced by that respective wearable loudspeaker unit; and the base unit is operable to subsequently transmit a command to the respective wearable loudspeaker unit to reproduce the selected audio data.

11. A base unit according to claim 9, in which the base unit is operable to transmit a command to a respective wearable loudspeaker unit to apply a processing effect to audio data that is being reproduced.

12. An audio system comprising:

at least a first wearable loudspeaker unit in accordance with claim 1; and a base unit comprising:

a processor;

a wireless communications unit operable to communicate wirelessly with one or more wearable loudspeaker units using a protocol that distinguishes each wearable loudspeaker unit from each other wearable loudspeaker unit in communication with the base unit; and in which the wireless communications unit is operable to receive from a respective wearable loudspeaker unit a signal indicating a respective one of a plurality of wearable loudspeaker unit wearing positions on a user's body for a respective wearable loudspeaker unit; and the processor is operable to select a respective one of a plurality of different audio data that corresponds to the indicated wearing position of the respective wearable loudspeaker unit for transmission by the wireless communications unit to that respective wearable loudspeaker unit.

13. An audio system according to claim 12, in which the base unit comprises a videogame platform; and the reproduction of the received audio data is responsive to a game event relating to the respective wearable loudspeaker unit wearing position on the user's body.

14. An audio system comprising:

a base unit in accordance with claim 6; and at least a first wearable loudspeaker unit comprising:

a loudspeaker;

an audio reproduction processor;

a wireless communications unit operable to communicate wirelessly with the base unit using a protocol that distinguishes the wearable loudspeaker unit from any other wearable loudspeaker units in communication with the base unit; and in which the wireless communications unit is operable to receive audio data corresponding to a selected wearing position of the wearable loudspeaker unit from the base unit; and the audio reproduction processor is operable to output the received audio data through the loudspeaker.

15. An audio system according to claim 14, in which the base unit comprises a videogame platform; and the reproduction of the received audio data is responsive to a game event relating to the respective wearable loudspeaker unit wearing position on the user's body.

16. A method of audio reproduction for a wearable loudspeaker unit, the method comprising the steps of:

selecting at the wearable loudspeaker unit one of a plurality of wearable loudspeaker unit wearing positions on a user's body;

transmitting the selected wearing position of the wearable loudspeaker unit to a base unit;

receiving from the base unit a respective one of a plurality of different audio data corresponding to the respective selected wearing position of the wearable loudspeaker unit; and outputting the received audio data through the loudspeaker.

17. A method of audio reproduction for a base unit, the method comprising the steps of:

selecting at the base unit one of a plurality of wearable loudspeaker unit wearing positions on a user's body for one or more respective wearable loudspeaker units in communication with the base unit; and selecting at the base unit a respective one of a plurality of different audio data that corresponds to the selected wearing position of a respective wearable loudspeaker unit for transmission by the wireless communications unit of the base unit to that respective wearable loudspeaker unit.

18. A computer program product comprising a non-transitory storage medium storing computer software which, when executed by a computer, implements the steps of claim 17.

19. A method of audio reproduction for an audio system comprising a base unit and one or more wearable loudspeaker units in communication with the base unit, the method comprising the steps of:

selecting, by a processor, one of a plurality of wearable loudspeaker unit wearing positions on a user's body for each respective wearable loudspeaker unit; and selecting, by the processor, a respective one of a plurality of different audio data corresponding to the selected wearing position of a respective wearable loudspeaker unit for transmission by the base unit to that respective wearable loudspeaker unit.

* * * * *